US007892085B2

(12) United States Patent
Harris

(10) Patent No.: US 7,892,085 B2
(45) Date of Patent: Feb. 22, 2011

(54) DEVICES AND METHODS FOR PLAYING ELECTRONIC BINGO GAME

(75) Inventor: David James Harris, Cumming, GA (US)

(73) Assignee: Cadillac Jack, Inc., Duluth, GA (US)

( * ) Notice: Subject to any disclaimer, the term of this patent is extended or adjusted under 35 U.S.C. 154(b) by 687 days.

(21) Appl. No.: 11/775,469

(22) Filed: Jul. 10, 2007

(65) Prior Publication Data

US 2009/0017895 A1 Jan. 15, 2009

(51) Int. Cl.
*A63F 3/06* (2006.01)

(52) U.S. Cl. ..... 463/19; 273/269; 273/270

(58) Field of Classification Search ..... 463/16–19; 273/269, 270

See application file for complete search history.

(56) References Cited

U.S. PATENT DOCUMENTS 5,482,289 A 1/1996 Weingardt
5,935,002 A * 8/1999 Falciglia ..... 463/19
5,967,895 A * 10/1999 Kellen ..... 463/19
6,645,072 B1 * 11/2003 Kellen ..... 463/19
7,066,812 B2 * 6/2006 Fried et al. ..... 463/19
2006/0121971 A1 * 6/2006 Slomiany et al. ..... 463/16
2006/0135245 A1 * 6/2006 Hedrick et al. ..... 463/19
2006/0205468 A1 * 9/2006 Saffari et al. ..... 463/16
2007/0232379 A1 * 10/2007 Falciglia ..... 463/19
2009/0143130 A1 * 6/2009 Lind et al. ..... 463/19

* cited by examiner

*Primary Examiner*—James S McClellan
*Assistant Examiner*—Jay Trent Liddle
(74) *Attorney, Agent, or Firm*—Greenberg Traurig, LLP

(57) ABSTRACT

An electronic bingo game and method for playing the same is disclosed. A bingo card having a plurality of numbered spaces is presented to a player, in which at least one of the numbered spaces is hidden to the player's view, thereby forming covered and uncovered portions of the bingo card. A random number generator draws bingo numbers until the occurrence of a game ending event, which numbers are compared to the numbered spaces on both the covered and uncovered portions of the bingo card. If the pattern of numbers formed on the uncovered portion of the bingo card forms one or more of a set of designated winning bingo patterns, a first award is paid to the player. The player is then presented with the opportunity to reveal one or more of the covered spaces on the bingo card whereupon a second prize is paid if the pattern of numbers formed on the uncovered spaces forms one or more of a set of designated winning bingo patterns.

16 Claims, 6 Drawing Sheets

DEVICES AND METHODS FOR PLAYING ELECTRONIC BINGO GAME

FIELD OF THE INVENTION

The present invention relates to a gaming machine and, more particularly, to a casino-style electronic bingo gaming machine and a method for playing the same.

BACKGROUND OF THE INVENTION

The game of bingo has been popular around the world for hundreds of years and remains a popular game for enjoyment in homes, churches, casinos and Native American gaming facilities. Regardless of the specific form and nature of the playing environment, however, the rules of the game remain basically the same: Each participant is issued one or more unique bingo cards with numbers appearing in an arrangement of rows and columns, usually a five-by-five matrix. An assigned individual, using a ball blower, cage or similar device, selects or "calls" numbers in response to which the players of the game search their cards for the called number and mark their cards accordingly. The first player to mark his or her card in one or more of certain predetermined patterns, usually five contiguous numbers along a vertical, horizontal or diagonal line, wins the prize for that game.

With the advent of computers, electronic forms of bingo games, such as those employing slot-machine style cabinets and video displays, have emerged and become increasingly popular. Many of these electronic bingo games offer the same play options as traditional card and ball bingo but with added benefits and features such as attractive graphics and sounds. A processor uses a random number generator to assign numbers to the spaces on the bingo card and draw the bingo balls from a predetermined range of numbers, usually one through seventy-five. A database stores the set of predetermined winning patterns, as well as the payout amount for obtaining such patterns. The processor automatically marks the players' cards appearing on the gaming machine's display in the event of a match between the numbers drawn and the numbers appearing on the bingo cards, allowing for the quick completion of game play. Two or more of these games can be networked together in order to allow multiple individuals to play a game of bingo against one another, using a common ball draw.

Electronic bingo games of this nature are well known in the art. For example, one system discloses an electronic Bingo game in which a random number generator selects a first set of a predetermined number of Bingo balls. the selected numbers are compared to the numbers appearing on the player's Bingo card. If a predetermined winning pattern is obtained, the player receives a reward. The random number generator then selects a second set of a predetermined number of Bingo balls. If a player obtains a cover all Bingo pattern (i.e., every space on the card is covered) from the first and second outcome sets, the player is entitled to a second award.

With the recent growth in the electronic gaming machine market, competition between manufacturers to place their equipment in available venues has become fierce. When selecting which machines to put into their facilities, the operators of gaming establishments give paramount consideration to their patrons' preferences. The problem that arises, however, is that players quickly tire of a particular game. Accordingly, there is a need in the art for new and innovative concepts associated with electronic gaming machines that serve to keep players amused and, therefore, willing to continue playing the game, in addition to attracting new players.

SUMMARY OF THE INVENTION

The present disclosure is directed to an electronic bingo game utilizing a bingo card in which one or more of the numbers corresponding to the card's spaces is hidden from view upon commencement of play. The game may either be a "stand alone" device, in which the data processor resides on the game, or a network of individual game machines, in which case the data processor resides on a central computer system or server that controls each game machine. A series of game winning patterns are programmed into memory. After the player places a wager and commences play, a random number generator assigns numerical values or other indicia to each of the spaces on the bingo card from a predetermined range of numbers. The random number generator then draws balls from the predetermined range. The number of balls drawn by the random number generator can either be fixed or variable.

As the indicia are drawn, they are compared to the designations appearing in the spaces on the bingo card. Where a match occurs, the corresponding space is marked, including any spaces hidden from view. If the uncovered spaces form one or more of the game winning patterns, the player is awarded a prize corresponding to the value of that pattern. One or more of the hidden spaces is then revealed. If the revealed spaces form one or more of the game winning patterns, the player is eligible to win an additional prize. Upon termination of the game, the players holding bingo cards marked with game winning patterns are paid awards in accordance with a predetermined pay schedule. In one embodiment of the present disclosure, the revealing of the one or more hidden spaces occurs after the player makes an additional wager.

Many other advantages and features of the present disclosure will become apparent to one or ordinary skill in the art upon examination of the following drawings and detailed description. it is intended that all such additional systems, methods, features and advantages be included within this description, and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the disclosed systems and methods. Moreover, in the drawings, like reference numerals designate corresponding parts throughout the several views.

DETAILED DESCRIPTION

The present disclosure now will be described more fully hereinafter with reference to the accompanying drawings, in which some, but not all embodiments are shown. Indeed, the disclosed systems and methods may be embodied in many different forms and should not be construed as limited to the embodiments set forth herein. Rather, these embodiments are provided so that this disclosure will satisfy applicable legal requirements.

Figure 1A:
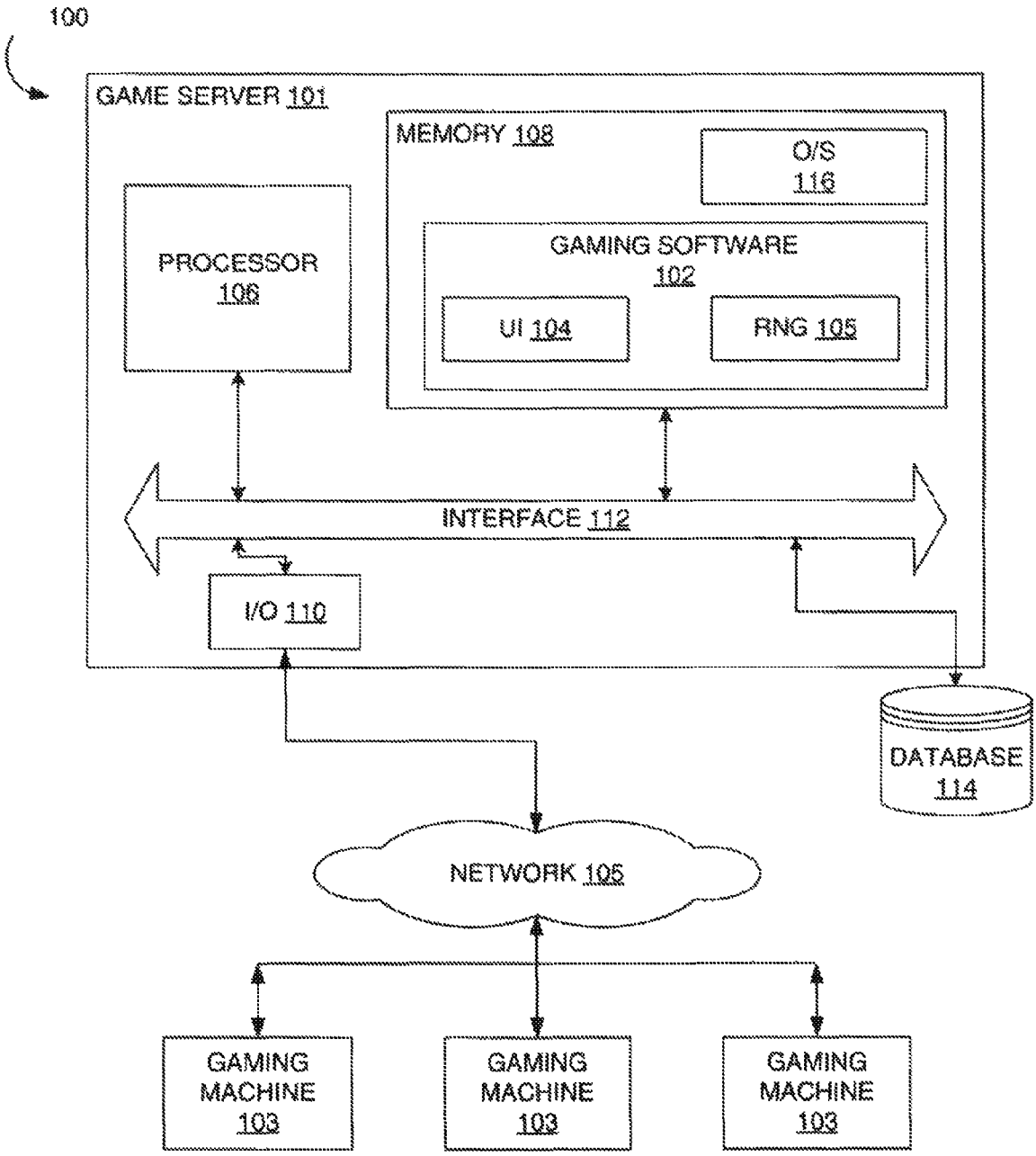
FIG. 1A shows a block diagram of an embodiment of a server-based gaming system for playing an electronic bingo game in accordance with the present disclosure.

FIG. 1A is a block diagram of an embodiment of a server-based gaming system 100 in accordance with the present disclosure in which the outcome of game play is centrally determined. The gaming system 100 includes a game server 101 networked to a plurality of individual gaming machines 103 via a network 105 (e.g., a local area network (LAN) such as an Ethernet connection or a wide area network). It is noted that the term "gaming machine" may refer to any device, activity or mode of play for gaming (i.e., gambling or redemption), amusement, competition, or other purposes. Each gaming machine 103 may be located locally or remotely with respect to one another.

In one embodiment of the present disclosure, the game server 101 can implement gaming software 102. The gaming software 102 can be implemented in software, as an executable program, and can be executed by a special or general purpose digital computer, such as a personal computer, workstation, minicomputer, or mainframe computer. The gaming software 102 includes a user-interface (UI) module 104 that provides display functions according to well-known webpage or screen display generation and formatting mechanisms. The gaming software 102 also includes a random number generator (RNG) 105. The RNG 105 comprises one or more modules of code configured to i) generate and assign numbers from a predetermined range to each of the spaces on a bingo card; and ii) draw numbers within said predetermined range for comparison to the numbers appearing on the bingo card, as further explained below. Although shown integral to the gaming software 102, one having ordinary skill in the art would understand in the context of this disclosure that the UI module 104 and/or RNG 105 can be modules distinct from the gaming software 102, and that each module may be further configured using a plurality of submodules.

Generally, in terms of hardware architecture, as shown in FIG. 1, the game server 101 includes a processor 106, memory 108, and one or more input and/or output (I/O) devices or peripherals 110 that are communicatively coupled via a local interface 112. The local interface 112 can be, for example, one or more buses or other wired or wireless connections. The local interface 112 may have additional elements (not shown) to enable communications, such as controllers, buffers, (caches), drivers, repeaters, and receivers. Further, the local interface 112 may include address, control, and/or data connections to enable appropriate communications among the aforementioned components. The game server 101 can also communicate with a database 114 via the local interface 112. The local data base 114, where various game data such as winning bingo card patterns and the amount paid for each are stored, can be external to or integral to the game server 101.

Processor 106 is a hardware device capable of executing software, particularly that stored in memory 108. The processor 106 can be any custom made or commercially available processor, a central processing unit (CPU), an auxiliary processor among several processors associated with the game server 101, a semiconductor based microprocessor (in the form of a microchip or chip set), a macroprocessor, or generally any device for executing software instructions.

Memory 108 can include any one or combination of volatile memory elements (e.g., random access memory or RAM) such as DRAM, SRAM, SDRAM and non-volatile memory elements such as read-only memory (ROM), hard drive, tape or CDROM. Moreover, the memory 108 may incorporate electronic, magnetic, optical, and/or other types of storage media. Note that memory 108 can have a distributed architecture, where various components are situated remote from one another, but can be accessed by the processor 106.

The gaming software 102 in memory 108 may include one or more separate programs, each of which comprises an ordered listing of executable instructions for implementing logical functions. In one example of the game server 101 of FIG. 1, the software in the memory 108 includes the gaming software 102 and a suitable operating system (O/S) 116. The operating system 116 essentially controls the execution of other computer programs, such as the gaming software 102, and provides scheduling input-output control, file and data management, memory management, and communication control and related services.

The gaming software 102 can be a source program, executable program (object code), script, and/or any other entity comprising a set of instructions to be performed. When a source program is utilized, the program may be translated via a compiler, assembler, interpreter, or the like, which may or may not be included within memory 108, so as to operate properly in connection with the operating system 116. Furthermore, the gaming software 102 can be written as (a) an object oriented programming language, which ahs classes of data and methods; or (b) a procedure programming language, which has routines, subroutines, and/or functions, for example but not limited to, C, C++, Pascal, Basic, Fortran, Cobol, Perl, Java, ASP, and Ada.

The gaming software 102 can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The gaming software 102 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

The I/O devices 110 may include input devices, such as a keyboard, mouse, scanner, microphone, etc., as well as interfaces to various devices. Furthermore, the I/O devices 110 may also include output devices, such as a printer, display, etc. Finally, the I/O devices 110 may further include devices that communicate both inputs and outputs, for instance a modulator/demodulator (modem for accessing another device, system, or network), a radio frequency (RF) or other transceiver, a telephonic interface, a bridge, a router, etc.

When the game server 101 is in operation, the processor 106 is configured to execute software stored within memory 108, to communicate data to and from memory 108, and to generally control operations of the game server 101 pursuant to the software. The gaming software 102 and the operating system 116, in whole or in part, but typically the latter, are read by the processor 106, perhaps buffered within the processor 106, and then executed.

Figure 1B:
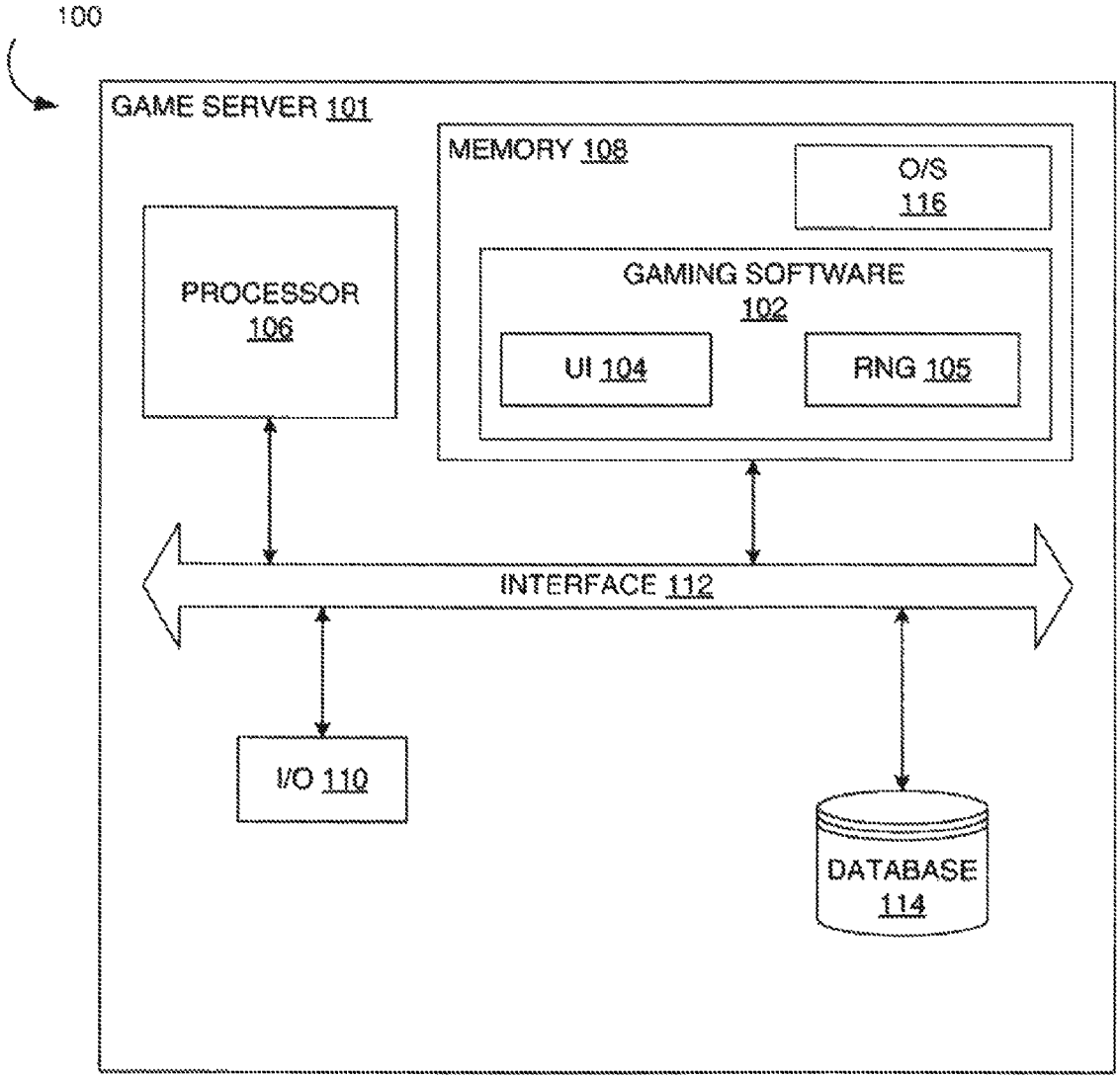
FIG. 1B shows a block diagram of an embodiment of a stand-alone gaming system for playing an electronic bingo game in accordance with the present disclosure.

FIG. 1B is a block diagram of an embodiment of a gaming system 100 in accordance with the present disclosure in which the system 100 consists of a "stand alone" player station or console in which the outcome of game play is determined locally. In such a system, the game server 101 and its associated components are resident on the individual gaming machines 103, rather than on a centrally based server that controls play or each gaming machine 103. Each of each of the components set forth in FIG. 1B function as described, above.

Figure 2:
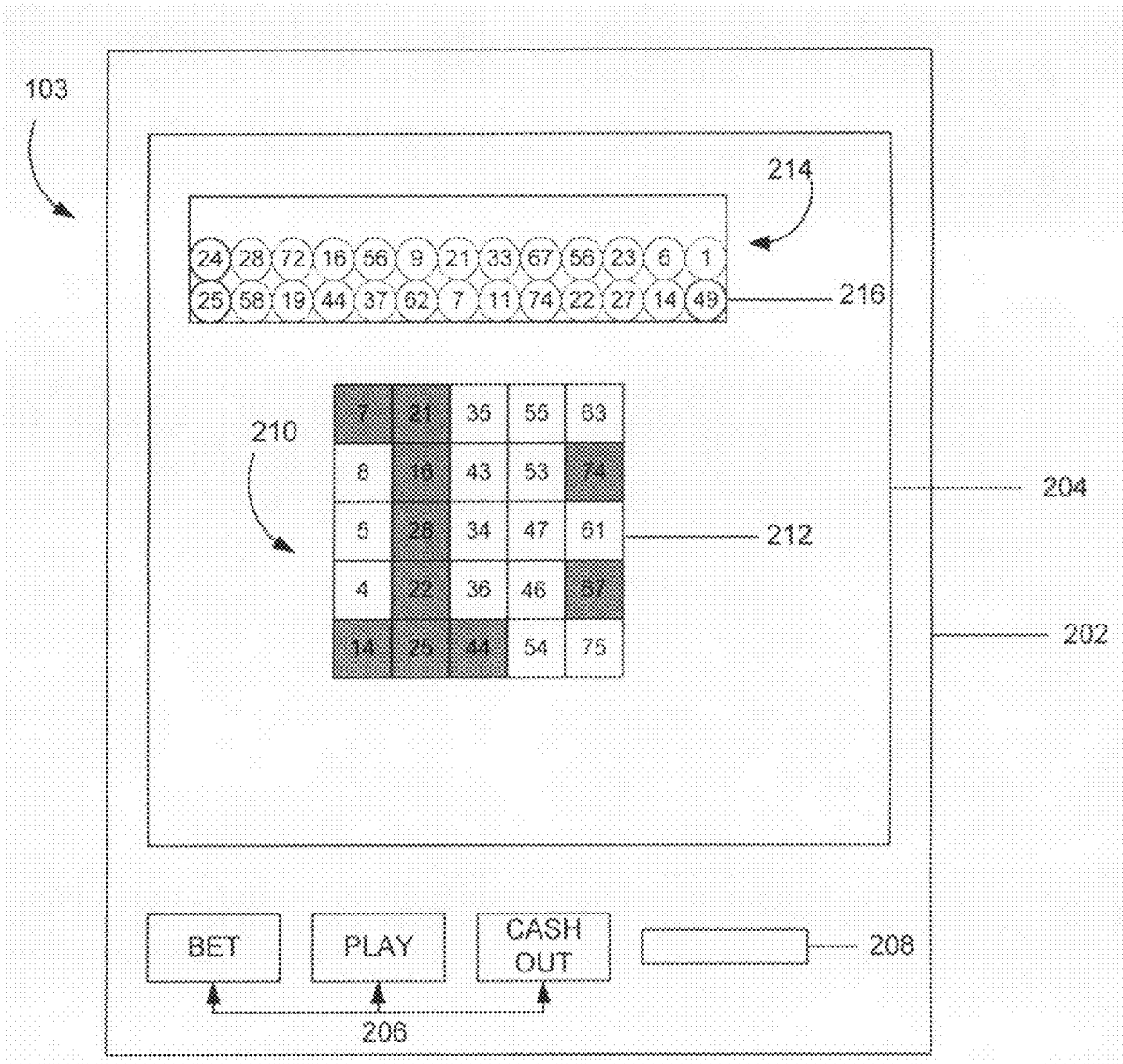
FIG. 2 shows an exemplary gaming machine for playing an electronic bingo game in accordance with the present disclosure.

FIG. 2 depicts an embodiment of a video gaming machine 103. The gaming machine 103 includes a cabinet 202 housing a display 204 for displaying game events. Typically, the display 204 is a flat panel LCD monitor. However, any display means known in the art may be employed.

Proximate to the display 204 are a series of electromechanical buttons 206 positioned on the cabinet for use as a user interface for controlling game play such as selecting a bet amount, commencing play and cashing out (i.e., terminating game play and retrieving the monetary value corresponding to the remaining game credits). The specific arrangement and function of each of the electromechanical buttons 206 is dependent upon the specific rules of the game being played on the gaming machine 103. In one embodiment, the display 204 is a "touch screen" monitor upon which icons corresponding to some or all of the electromechanical buttons 206 appear. The user can activate the functions associated with the icons by simply touching the appropriate area of the display 204 rather than depressing the electromechanical buttons 206.

The gaming machine 103 also includes a wager input interface 208, such as a bill acceptor into which a player inserts paper currency and receives credit on the gaming machine 103 for the amount deposited. In alternate embodiments, the wager input interface 208 can be a ticket reader, a magnetic card reader, or similar mechanisms, into which the player places a ticket or magnetic card encoded with a monetary value purchased from a cashier's station or vending machine.

The gaming software 102 in memory 108, controlled by the processor 106, causes a bingo card 210 to be generated as an image on the display 204. In the embodiment illustrated in FIG. 2, the Bingo card 210 appears in the form of a five-by-five matrix forming twenty-five spaces 212. However, any arrangement of rows and columns may be used. The RNG 105 causes numbers to be assigned to each of the spaces 212 on the bingo card 210 from a predetermined range of bingo numbers. Typically the range is one through seventy-five, although any range of numbers may be used. The RNG 105 also draws bingo numbers from the predetermined range during play of the game. In one embodiment, the bingo numbers generated by the RNG 105 are displayed graphically as bingo balls 214 in a ball display area 216 on the display 204.

The number of bingo numbers generated by the RNG 105 may either be fixed or variable. In the case of the former, the gaming software 102 causes the RNG 105 to select a predetermined number of numbers after which the bingo game terminates. In the case of a variable number of bingo numbers, the RNG 105 continues drawing numbers until the occurrence of a specific event, such as one of the players obtaining one of a predefined set of game winning patterns.

Figure 3A:
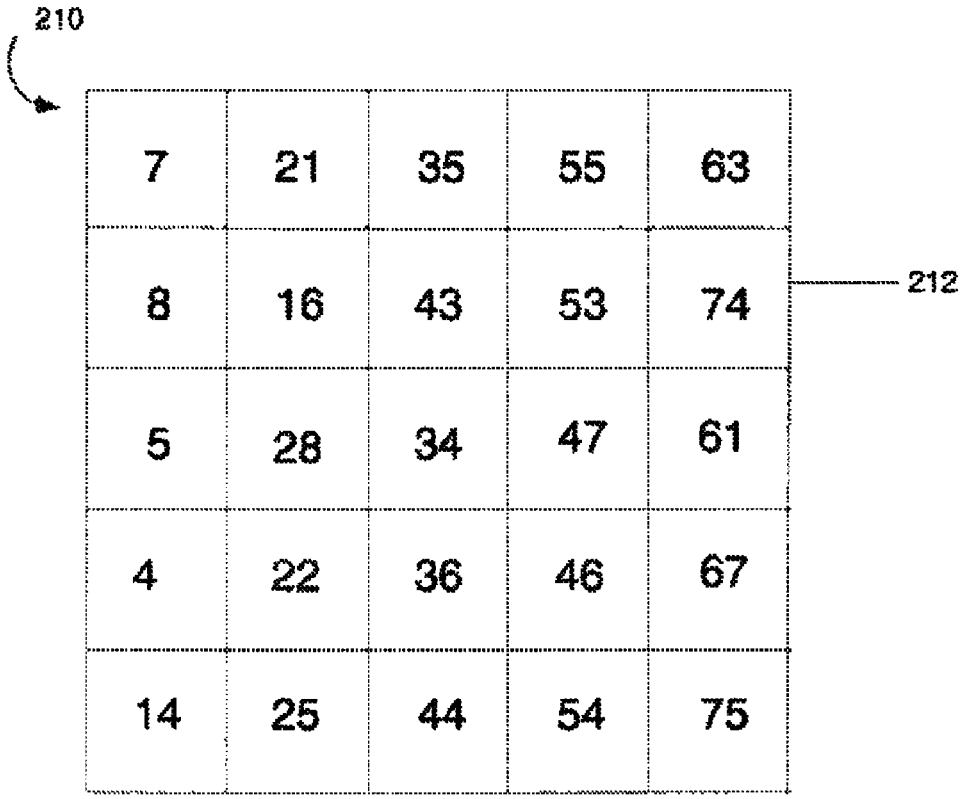
FIGS. 3A, 3B, 3C and 3D are illustrations of bingo cards used in connection with an embodiment of the bingo game according to the present disclosure.

FIG. 3A depicts a typical bingo card 210 for use in and electronic bingo game as known in the prior art. Each of the spaces 212 is assigned a number or other indicia. Any space matching a ball drawn during game play is marked. if the pattern appearing on the card matches one of a predefined set of game winning patterns, a prize corresponding to that pattern is awarded.

Figure 3B:
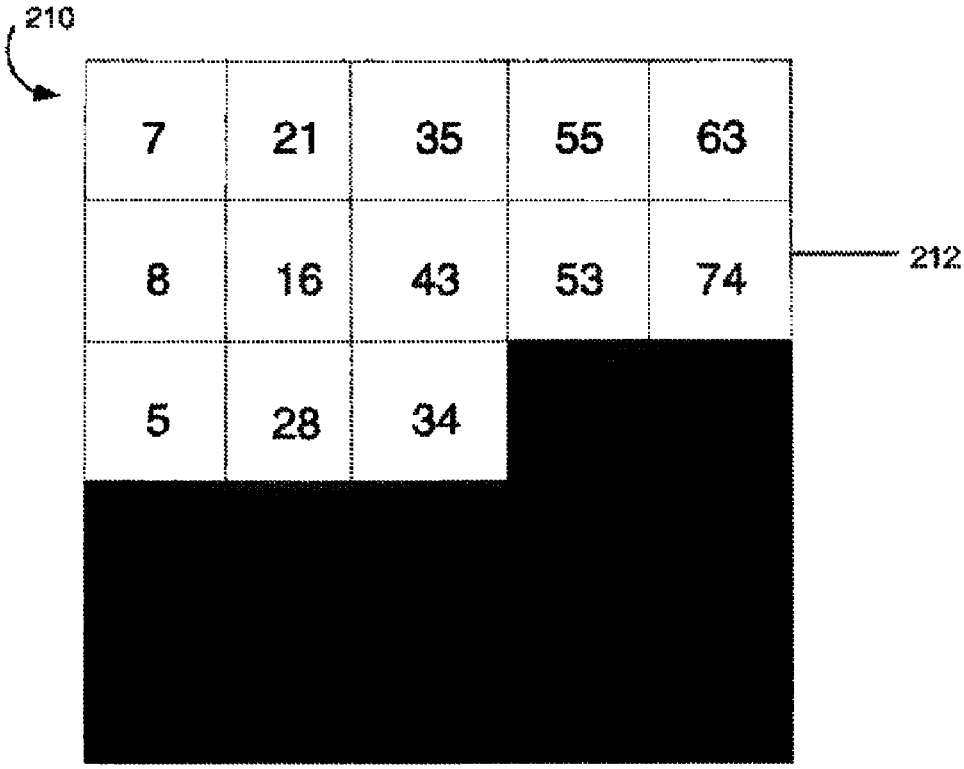

FIG. 3B depicts a bingo card 210 in accordance with present disclosure, at the commencement of play of the gaming machine 103. One or more of the spaces 212 on the bingo card 210 is hidden from the player's view. Later in the game, the player is presented with the opportunity to reveal one or more of the hidden spaces, as detailed below.

Figure 3C:
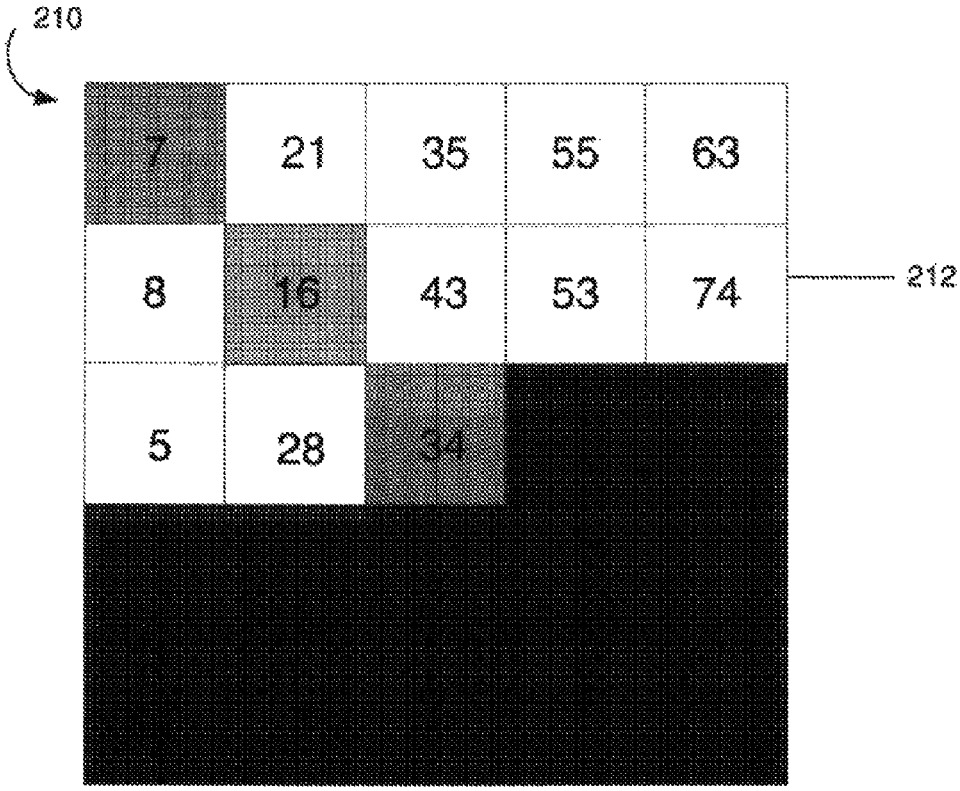

FIG. 3C depicts a bingo card 210 in accordance with the present disclosure, after the RNG 105 has generated the bingo numbers. Any space bearing a number corresponding to one of the drawn numbers is marked. This includes the spaces hidden from view. If the marked spaces that are visible to the player form one or more of the predetermined game winning patterns, the player is awarded a prizes corresponding to the pattern or patterns.

Figure 3D:
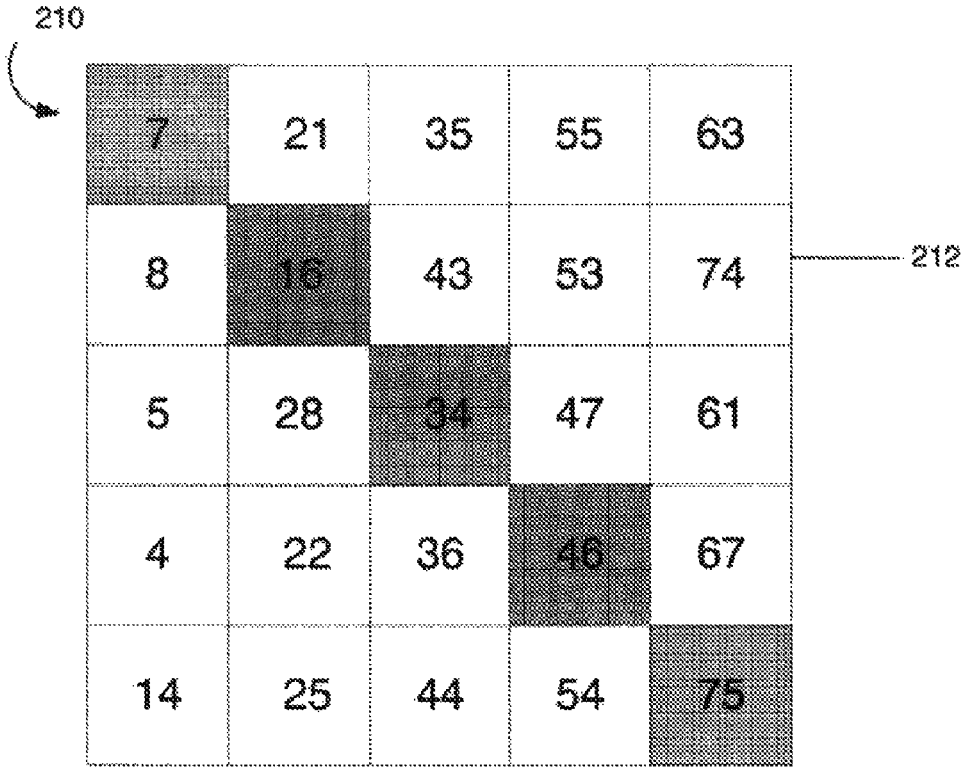

FIG. 3D depicts a bingo card 210 in accordance with the present disclosure, after the player has elected to reveal the previously-hidden spaces. If the marked spaces form one or more of the predetermined game winning patterns, the player is awarded a prize corresponding to the pattern or patterns.

Figure 4:
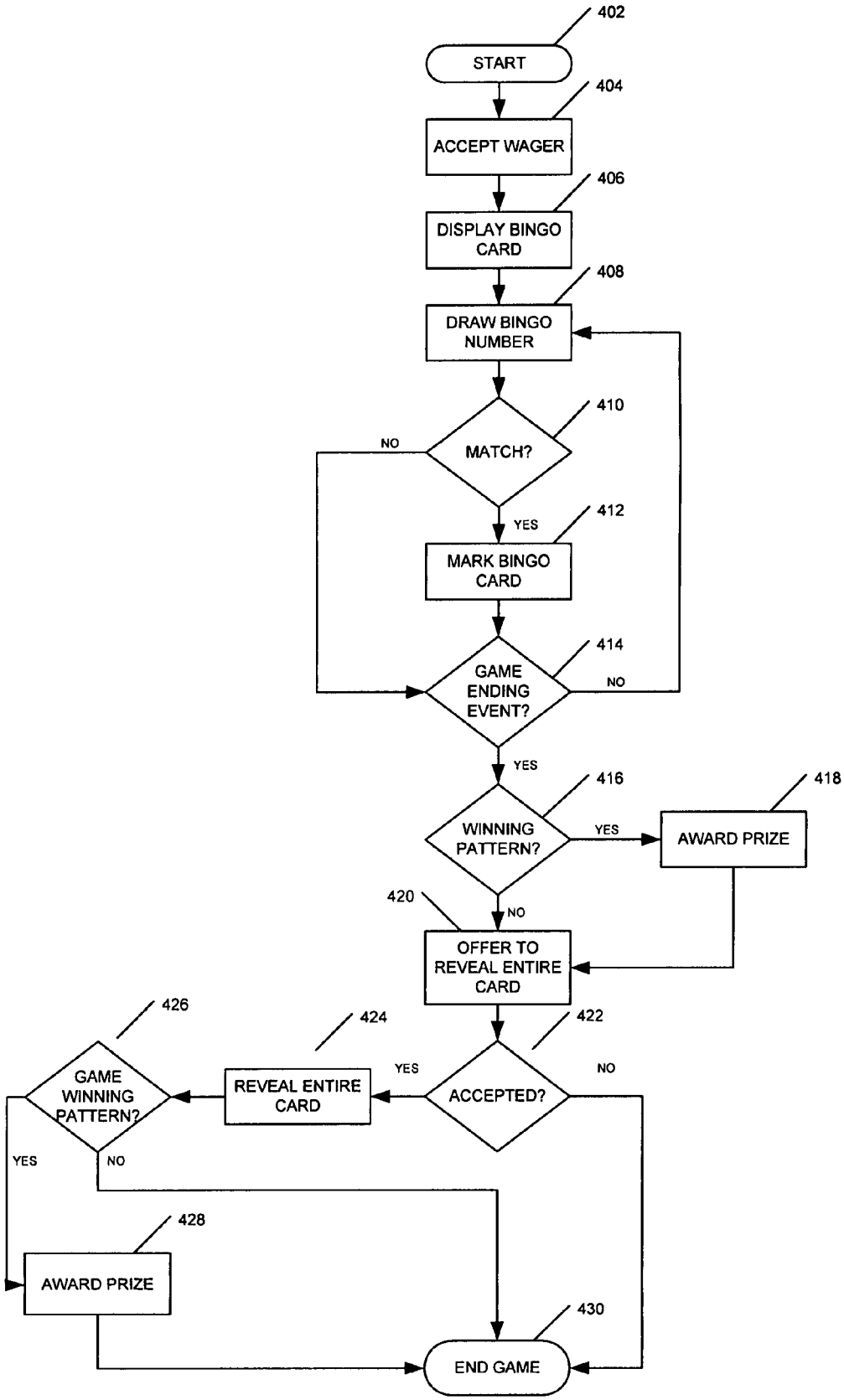
FIG. 4 is a flow diagram illustrating the logical sequence of steps in playing a bingo game in accordance with the present disclosure.

FIG. 4 shows an exemplary flowchart of a game of bingo in accordance with the present disclosure. As described with reference to FIG. 4, to initiate play of the bingo game, the player first invokes step 404 to place a wager. To place a wager, the user inputs currency or a ticket bearing game credits into the wager input interface 208 and receives credit on the gaming machine 103 for the amount deposited. In an exemplary embodiment of the present disclosure, the game machine 103 indicates the amount of money or credit available for the player to wager during play on the display 204. The player then indicates a wager amount using the electromechanical buttons 206 or the touch screen on the display 204, up to the lesser of the available game credits or the maximum allowable bet on the gaming machine.

After the placing of a wager in accordance with step 404, step 406 is invoked to initialize the game by displaying a bingo card 210 on the display 204 after which the RNG 105 assigns a number or other indicia to each of the spaces 212 on the bingo card 210 from a predetermined range of numbers or indicia. As described above, one or more of the spaces on the bingo card is hidden from the player's view. Upon commencement of game play, either through use of the electromechanical buttons 206 or the touch screen on the display 204, step 408 is invoked, causing the RNG 105 to generate numbers from the predefined range. In one embodiment, a graphical representation of a bingo ball 214 bearing such indicia is displayed in the ball display area 216 of the display 204.

According to step 410, the indicium generated by the RNG 105 is compared to those appearing on the bingo card 210. If the generated indicium matches an indicium appearing in one of the spaces 212 on the bingo card, step 414 is invoked to mark that space by shading or similar means appreciable by one of ordinary skill in the art. Although hidden from view, any match between the indicia and the hidden spaces is noted by the processor 106 for potential use later in the game, as described below.

This process is continued until the occurrence of a game ending event, as determined at step 414. In one embodiment of the present disclosure, the gaming software 102 causes the RNG 105 to draw a predetermined number of indicia in which the drawing of the final indicium constitutes the game ending event at step 414. For example, the game may be programmed to draw thirty indicia in which the terminating event is the drawing of the thirtieth ball. In another embodiment of the present disclosure, the game ending event occurs when one of the players obtains one of a predefined set of game winning patterns.

Upon the occurrence of the game ending event at step 414, step 416 is invoke to determine whether the marked spaces on the uncovered portion of the bingo card 210 yields one or more of the predefined game winning patterns. If such a pattern is formed, the player is awarded a corresponding prize in accordance with step 418.

At this point, the player may elect to reveal one or more of the hidden spaces in accordance with step 420. In one embodiment, the player may reveal the hidden spaces after making an additional wager. The hidden spaces may all be revealed at once or, alternatively, in several steps. In the case of the latter, the player places an additional wager each time additional spaces are revealed. If the player declines to make the additional wager, the game ends. Otherwise, step 424 is invoked and one or more of the hidden spaces is revealed. If the marked spaces on the revealed portion of the bingo card 210 forms one or more of the predefined game winning patterns, the player is awarded a corresponding prize in accordance with step 428. The prize is paid in addition to any prizes previously paid in accordance with step 418.

It should be emphasize that the above-described embodiments, particularly, any "preferred" embodiments, are merely possible examples of implementations, merely set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

What is claimed is:

1. An electronic bingo game comprising:

a display;

an interface capable of accepting instructions from a player to initiate play of the bingo game;

a memory capable of storing a plurality of software instructions, one or more winning bingo patterns and pay table information corresponding to said one or more winning bingo patterns;

a random number generator capable of randomly selecting indicia from a predefined range of indicia;

a processor for controlling the display, the interface and the random number generator, wherein the processor implements the following software instructions:

(a) generating a bingo card on the display, the bingo card having a plurality of spaces, including one or more covered spaces so as to form a hidden portion and an unhidden portion of the bingo card;

(b) assigning indicia from the predefined range of indicia to each of the plurality of spaces on the bingo card;

(c) until the occurrence of a game ending event, iteratively selecting indicia from the predefined range, comparing the selected indicia to the indicia assigned to the plurality of spaces on the bingo card and identifying each of the plurality of spaces for which a match occurs;

(d) paying a first award to the player if the pattern of identified spaces on the unhidden portion of the bingo card corresponds to one of said one or more winning bingo patterns;

(e) after the game ending event, offering a player an option to play one or more of said one or more covered spaces;

(f) responsive to a player accepting the option to play one or more of said one or more covered spaces, revealing one or more of said one or more covered spaces contained in the hidden portion of the bingo card and paying a second award to the player if the pattern of identified spaces formed on the uncovered spaces on the bingo card corresponds to one of said one or more winning bingo patterns; and (g) responsive to a player declining the option to play one or more of said one or more covered spaces, ending the game.

2. The electronic bingo game of claim 1, wherein the game ending event is the drawing of a predetermined number of indicia by the random number generator.

3. The electronic bingo game of claim 1, wherein the game ending event is the formation of a pattern on the unhidden portion of the bingo card corresponding to the at least one winning bingo pattern.

4. The electronic bingo game of claim 1 in which the value of the second award is proportional to the number of hidden spaces on the hidden portion of the bingo card.

5. An electronic bingo game comprising:

a display;

an interface capable of accepting instructions from a player to initiate play of the bingo game;

a memory capable of storing a plurality of software instructions, one or more winning bingo patterns and pay table information corresponding to said one or more winning bingo pattern;

a random number generator capable of randomly selecting indicia from a predefined range of indicia;

a processor for controlling the display, the interface and the random number generator, wherein the processor implements the following software instructions:

(a) generating a bingo card on the display, the bingo card having a plurality of spaces, including one or more covered spaces so as to form a hidden portion and an unhidden portion of the bingo card;

(b) assigning indicia from the predefined range of indicia to each of the plurality of spaces on the bingo card;

(c) until the occurrence of a game ending event, iteratively selecting indicia from the predefined range, comparing the selected indicia to the indicia assigned to the plurality of spaces on the bingo card and identifying each of the plurality of spaces for which a match occurs;

(d) paying a first award to the player if the pattern of identified spaces on the unhidden portion of the bingo card corresponds to of said one or more winning bingo patterns;

(e) after the game winning event, offering a player an option to play said one or more covered spaces; and (f) responsive to a player accepting the option to play said one or more covered spaces, revealing the entirety of the hidden portion of the bingo card and paying a second award to the player if the pattern of identified spaces formed on the plurality of spaces on the bingo card corresponds to said one or more winning bingo patterns.

(g) responsive to a player declining the option to play said one or more covered spaces, ending the game.

6. The electronic bingo game of claim 5, wherein the game ending event is the drawing of a predetermined number of indicia by the random number generator.

7. The electronic bingo game of claim 5, wherein the game ending event is the formation of a pattern on the unhidden portion of the bingo card corresponding to the at least one winning bingo pattern.

8. The electronic bingo game of claim 5 in which the value of the second award is proportional to the number of hidden spaces on the hidden portion of the bingo card.

9. A method of playing an electronic bingo game comprising the steps of:

providing a bingo card on a gaming machine to a player, the bingo card having a plurality of spaces, including one or more covered spaces so as to form a hidden portion and an unhidden portion of the bingo card;

assigning indicia via a processor from a predefined range of indicia to each of the plurality of spaces on the bingo card;

until the occurrence of a game ending event, iteratively selecting indicia from the predefined range, comparing the selected indicia to the indicia assigned to the plurality of spaces on the bingo card and identifying each of the plurality of spaces for which a match occurs;

paying a first award to the player if the pattern of identified spaces on the unhidden portion of the bingo card corresponds to one or more winning bingo patterns;

after the game ending event offering a player via the processor an option to play one or more of said one or more covered spaces;

responsive to a player accepting the option to play one or more of said one or more covered spaces, revealing one or more of the at least one covered spaces contained in the hidden portion of the bingo card and paying a second award to the player if the pattern of identified spaces formed on the uncovered spaces on the bingo card corresponds to said one or more winning bingo patterns; and responsive to a player declining the option to play one or more of said one or more covered spaces, ending the game.

10. The method of claim 9, wherein the game ending event is the drawing of a predetermined number of numbers by the random number generator.

11. The method of claim 9, wherein the game ending event is the formation of a pattern on the unhidden portion of the bingo card corresponding to the at least one winning bingo pattern.

12. The method of claim 9 in which the value of the second award is proportional to the number of hidden spaces on the hidden portion of the bingo card.

13. A method of playing an electronic bingo game comprising the steps of:

providing a bingo card on a gaming machine to a player, the bingo card having a plurality of spaces, including one or more covered space so as to form a hidden portion and an unhidden portion of the bingo card;

assigning indicia via a processor from a predefined range of indicia to each of the plurality of spaces on the bingo card;

until the occurrence of a game ending event, iteratively selecting indicia from the predefined range, comparing the selected indicia to the indicia assigned to the plurality of spaces on the bingo card and identifying each of the plurality of spaces for which a match occurs;

paying a first award to the player if the pattern of identified spaces on the unhidden portion of the bingo card corresponds to one or more winning bingo patterns;

after the game ending event offering a player via the processor an option to play said one or more covered spaces;

responsive to a player accepting the option to play said one or more covered spaces, revealing the hidden portion of the bingo card and paying a second award to the player if the pattern of identified spaces formed on the plurality of spaces corresponds to the at least one winning bingo pattern; and responsive to a player declining the option to play said one or more covered spaces, ending the game.

14. The method of claim 13, wherein the game ending event is the drawing of a predetermined number of numbers by the random number generator.

15. The method of claim 13, wherein the game ending event is the formation of a pattern on the unhidden portion of the bingo card corresponding to the at least one winning bingo pattern.

16. The method of claim 13 in which the value of the second award is proportional to the number of hidden spaces on the hidden portion of the bingo card.

* * * * *

UNITED STATES PATENT AND TRADEMARK OFFICE

CERTIFICATE OF CORRECTION

PATENT NO. : 7,892,085 B2
APPLICATION NO. : 11/775469
DATED : February 22, 2011
INVENTOR(S) : David James Harris It is certified that error appears in the above-identified patent and that said Letters Patent is hereby corrected as shown below:

Column 8, line 38, after "corresponds to" insert -- one --.

Signed and Sealed this
Thirty-first Day of May, 2011

David J. Kappos
*Director of the United States Patent and Trademark Office*